US005293797A

United States Patent [19]

Spalding et al.

[11] Patent Number: 5,293,797

[45] Date of Patent: Mar. 15, 1994

[54] MULTIPLE POINT DELIVERY APPARATUS FOR SEPARATING OF SHEET-LIKE ELEMENTS

[75] Inventors: Michael H. Spalding, De Pere; Frederick A. Benjamin, Howard; Kenneth S. Mielcarek, Pulaski, all of Wis.

[73] Assignee: John Brown, Inc., Oconto Falls, Wis.

[21] Appl. No.: 455,267

[22] Filed: Dec. 22, 1989

[51] Int. Cl.[5] ..... B65H 29/60

[52] U.S. Cl. ..... 83/107; 83/98; 83/102; 83/110; 271/303; 271/309

[58] Field of Search ..... 83/102, 105, 106, 107, 83/98, 402, 110; 271/303, 305, 309

[56] References Cited

U.S. PATENT DOCUMENTS

| | | | |
|---|---|---|---|
| 3,391,777 | 7/1968 | Joa | 271/303 X |
| 3,550,493 | 12/1970 | Benbenek et al. | 83/106 X |
| 3,976,237 | 8/1976 | Bossons | 83/98 X |
| 4,245,530 | 1/1981 | Frye et al. | 83/402 X |
| 4,373,713 | 2/1983 | Loebach | 83/105 X |
| 4,538,800 | 9/1985 | Richter | 83/106 X |
| 4,729,282 | 3/1988 | Kasdorf | 83/102 X |
| 4,919,027 | 4/1990 | Littleton | 83/107 |

FOREIGN PATENT DOCUMENTS

| | | | |
|---|---|---|---|
| 1208969 | 10/1970 | United Kingdom | 271/303 |
| 1541562 | 3/1979 | United Kingdom | 271/303 |

*Primary Examiner*—Eugenia Jones
*Attorney, Agent, or Firm*—Andrus, Sceales, Starke & Sawall

[57] ABSTRACT

A sheet diverter apparatus diverts sheets into alternate paths by guiding the leading portion of each sheet through a gap in a horizontal conveyor into alternate diverter belt conveyor units where the sheet is firmly grasped for transfer. The one conveyor unit is a horizontal unit having a top belt conveyor and a bottom belt conveyor, one of which is offset downstream to form a diverting gap. A diverter is located to successively rotate through the gap and divert the alternate sheet into the angulated conveyor unit. In an upwardly angulated conveyor, the horizontal moving sheet is supported by the bottom conveyor belt of the horizontal unit. In a downward angulated conveyor unit, the length of the gap is selected to maintain sheet flow across a gap in the plane of the sheet. The top conveyor of the horizontal unit assists the support of the horizontal sheet. The linear or surface speed of the diverter cam is greater than the linear speed of the sheet. The cam surface is constructed with a low friction surface such as provided by a low friction plastic coating. An air cushion may be created between the cam face of the diverter and the sheet. A low pressure air passageway through the diverter terminates in the face of the cam and establishes a thin air film between the sheet and the cam surface. The air film prevents adverse interengagement between the cam and the sheet.

19 Claims, 2 Drawing Sheets

MULTIPLE POINT DELIVERY APPARATUS FOR SEPARATING OF SHEET-LIKE ELEMENTS

BACKGROUND OF THE PRESENT INVENTION

This invention relates to a multiple point delivery apparatus for separating a series of sheet-like elements moving in a common horizontal path.

In the forming of printed articles, a series of the articles are formed and subsequently assembled. The forming of the articles preferably involves an on-line system in which a web of indefinite length is passed through printing, cutting and forming apparatus to form individual sheet-like elements. The elements may be individual sheets, folded sheets with a common edge within the web and the like, and the terminology of sheet and sheet-like element is used herein to generally refer to such separate elements. The printing, forming and processing can normally e completed in high speed in-line apparatus. The articles from the in-line apparatus are normally discharged at a rate in excess of that which can be incorporated into the final processing, such as assembling, stacking or the like. To maintain in-line operation, various separating systems have been proposed for receiving of the in-line articles as produced and diverting of the articles into two or more streams thereby permitting a reduced rate of final assembly and processing. A widely proposed system includes a belt conveyor system having an in-line path, and one or more angulated offset paths. A particularly satisfactory apparatus is disclosed in the copending application of Kenneth Mielcarek et al, and entitled "Multiple Point Delivery Apparatus For Separating And Delivering A Series Of Articles To A Plurality Of Discrete Receiving Devices".

The diverter apparatus as disclosed in the above identified application includes a horizontal conveyor belt unit and an angulated or offset conveyor belt unit. The horizontal conveyor belt unit includes a continuous top belt and a spaced bottom belt conveyor defining a sheet path with a diverting gap. The offset conveyor unit includes a bottom belt with a upstream end located adjacent and immediately beneath the upstream end of the top conveyor unit and a top belt extending from the downstream end of the diverting gap. A pair of diverters are mounted to the opposite sides of the diverter conveyor units, and each diverter element has opposed diverting cams which pass through the respective horizontal and offset paths within the gap to support the sheet-like elements. The cams have a circumferential length approximately three times the length of the gap and move into the gap slightly downstream of the upstream end of the gap to engage and support the sheet moving through the gap.

Other prior art structures are discussed in the above application. Generally, the prior art has stressed the necessity and desirability of supporting the sheet-like element with a top and a bottom supporting member during the complete travel through the gap to insure the proper transfer from a cutter apparatus or other source into the diverter with an essentially continued control of the movement of the sheet-like element.

SUMMARY OF THE PRESENT INVENTION

The present invention is directed to a diverter apparatus for moving of a series of sheet-like elements in alternate paths for subsequent processing and particularly a first horizontal path and a second angulated path relative to the first horizontal path.

The inventors have discovered that, in association with the sheet movement through the diverter, the most significant factors involves guiding the leading portion or edge of the sheet element into and through the trailing end or downstream end of the gap such that the sheet element is positively moved into the diverter's conveyor belt structure. Once the diverter's conveyor belts firmly grasp the sheet element, transfer of the total element through the desired path is established. The diverter can therefore be formed with a cam surface of a relatively short circumferential length by appropriate locating and rotating of the diverter to insure the support of the leading portion of the sheet-like member including the leading most edge portion for transfer into the diverter belt conveyor. Although the diverter can of course be extended beyond the necessary length, such additional support structure is generally not needed except where very particular materials are used which may require special consideration. The design of the diverter structure to control the leading edge portion provides an extremely cost effective, reliable structure for the diversion of the various sheet-like elements.

In the moving of the diverted sheet or other flexible sheet-like elements into the alternate paths, at least one of the elements is preferably transferred in a planar path having a substantial horizontal extent including the in-feed plane of the element. A diverter is located to successively rotate into the gap and divert selected elements from the planar path into an alternate angulated planar path. The gap structure is oriented and arranged to permit the linear in-line movement of the element with the significant horizontal path. Thus, the inventor has discovered that generally the element, particularly where it has a length in excess of the length of the gap, maintains its flow and path across a gap in the plane of sheet movement sufficient to divert the sheet into the gap by a rotating diverter. Generally, where an alternate downwardly oriented path is used, the path with the significant horizontal component is preferably formed with a continuous top belt forming an appropriate spanning of the gap. Even though the continuous belt does not actually support the member, the rapid movement forms an interaction with the member tending to maintain the member in its initial path across the path. In an apparatus having an upward angulated path, a continuous bottom belt unit is used to support the horizontal sheet flow.

In accordance with a further aspect of this invention, the inventors have discovered that the linear or surface speed of the diverter surface can be varied significantly from the linear surface speed of the sheet-like element being diverted. The cam surface is preferably constructed with a low friction surface, such as provided by a low friction plastic coating or the like. An air cushion may also be created between the cam face of the diverter and the sheet. A low pressure air passageway through the diverter, for example, can establish a thin air film between the sheet and the cam surface. With the air film, essentially no interengagement between the hard surface of the diverter as such and the sheet element occurs. This provides a gentle, continuous appropriate support for the sheet element while eliminating the various problems associated heretofore with diverters, and the conventional practice which teaches the necessity of having the cam surface essentially at the linear speed of the sheet element into and through the diverting gap.

BRIEF DESCRIPTION OF THE DRAWINGS

The drawings furnished herewith generally illustrate the best mode presently contemplated for carrying out the invention and are described hereinafter.

In the drawings.

DESCRIPTION OF THE ILLUSTRATED EMBODIMENT

Figure 1:
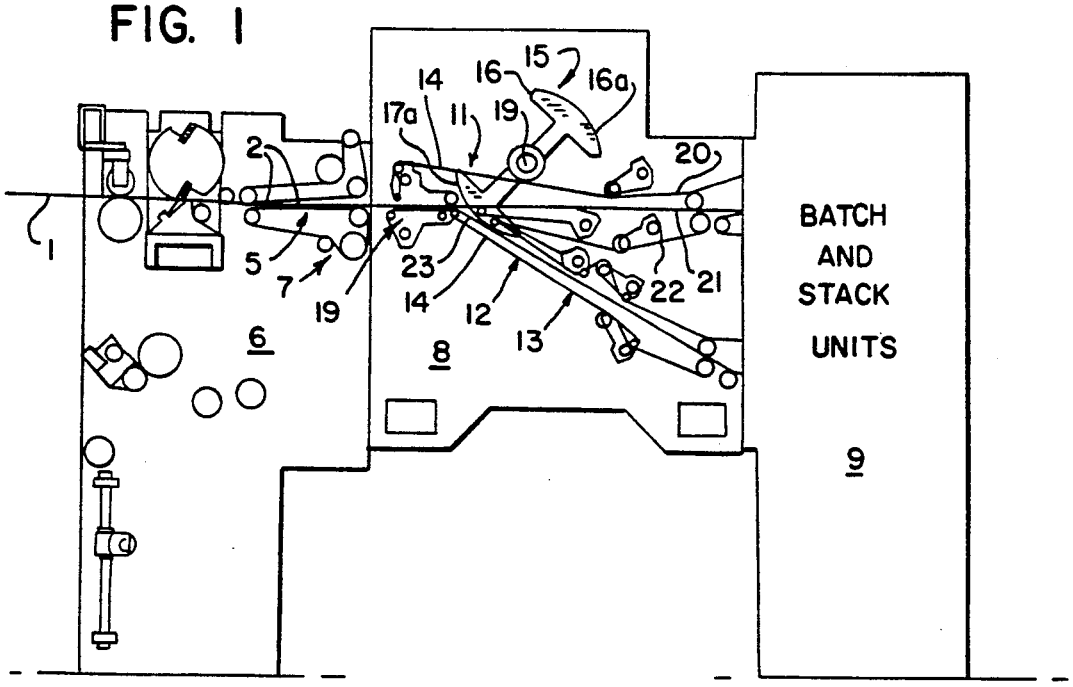
FIG. 1 is a side elevational view of a web line including a diverter apparatus constructed in accordance with the teaching of the present invention for separating formed sheet-like elements.
Figure 2:
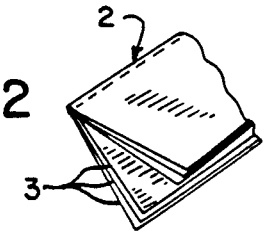
FIG. 2 is a simplified view of the sheet-like element shown in FIG. 1.

Referring to the drawings and particularly to FIGS. 1 and 2, the illustrated processing line is shown for processing a web 1 of indefinite length to form a plurality of individual sheet-like elements 2. The present invention is particularly applicable to folded signatures having a plurality of like pages 3 which are interleaved and folded to form a signature 2, such as shown in FIG. 2. The signature 2 has the folded edge 4 extending longitudinally of the flow path 5 through a signature separating and processing line. A rotary cutter unit 6 is shown operable to separate the web 1 into a series of signatures 2 which are discharged in-line in a horizontal plane in path 5. A coupling belt conveyor 7 receives and transfers the successive signatures 2 into a multiple point delivery apparatus or unit 8 for separation and diversion into the various appropriate downstream processing apparatus such as a batch, stacker or the like and shown diagrammatically at 9. The construction of the multiple point delivery unit 8 particularly forms the subject matter of the present invention.

In the illustrated embodiment of the invention, the apparatus 8 includes a horizontal conveyor unit 11 mounted in-line with the coupling belt conveyor 7 and an offset conveyor unit 12 having a downwardly projecting portion 13 for transport of the elements downwardly for discharge into a spaced horizontal path to that of conveyor unit 11.

Each of the conveyor units 11 and 12 is a tape or belt conveyor which includes similar laterally spaced belts 14 with a free space therebetween and defining a planar support for transporting of the signatures. A plurality of laterally spaced and offset diverters 15 are rotatably mounted to the top of the conveyor units 11 and 12. Each diverter 15 is aligned with a space between belts 14 and rotates between the belts of conveyor units 11 and 12. Each diverter 15 has a cam surface which engages alternate signature 2 moving through the delivery unit 8 to establish movement of the alternate signatures 2 through the inclined or offset conveyor unit 12 while the other group of alternate elements pass through the horizontal conveyor unit 11.

Figure 3:
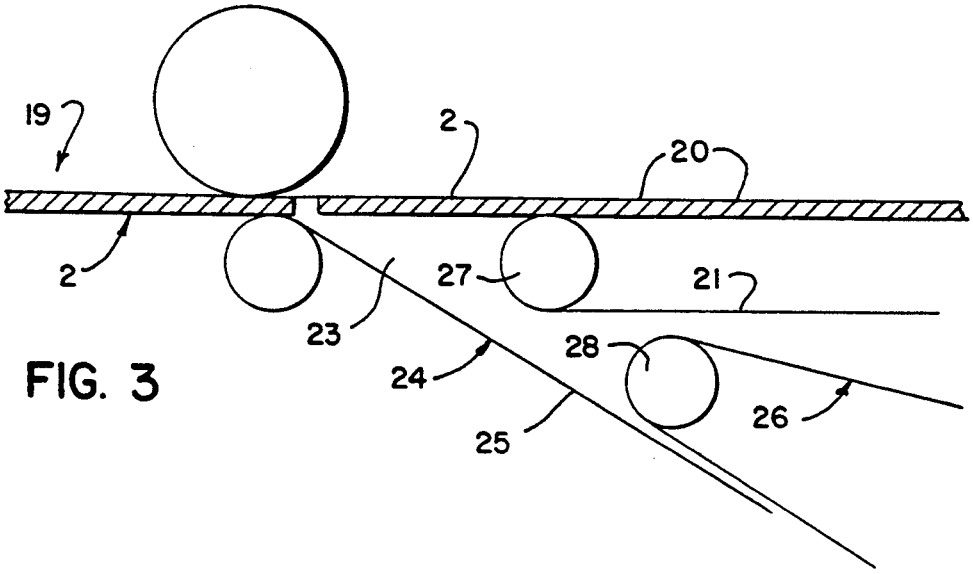
FIG. 3 is an enlarged and simplified view of a portion of the diverter shown in FIG. 1.

Referring particularly to FIGS. 1 and 3, diverter 15 is a generally bow-tie shaped member having similar cam sections or segments 16 and 17 projecting radially in diametrically opposite directions from a common hub 18. The outer peripheries and cam surfaces 16*a* and 17*a* of the diverter segments 16 and 17 have a common radius. The diverters 15 are rotatably mounted on a common drive shaft 19 with the peripheral cam surfaces 16*a* and 17*a* moving in the direction of the signatures 2 through unit 8.

Figure 4:
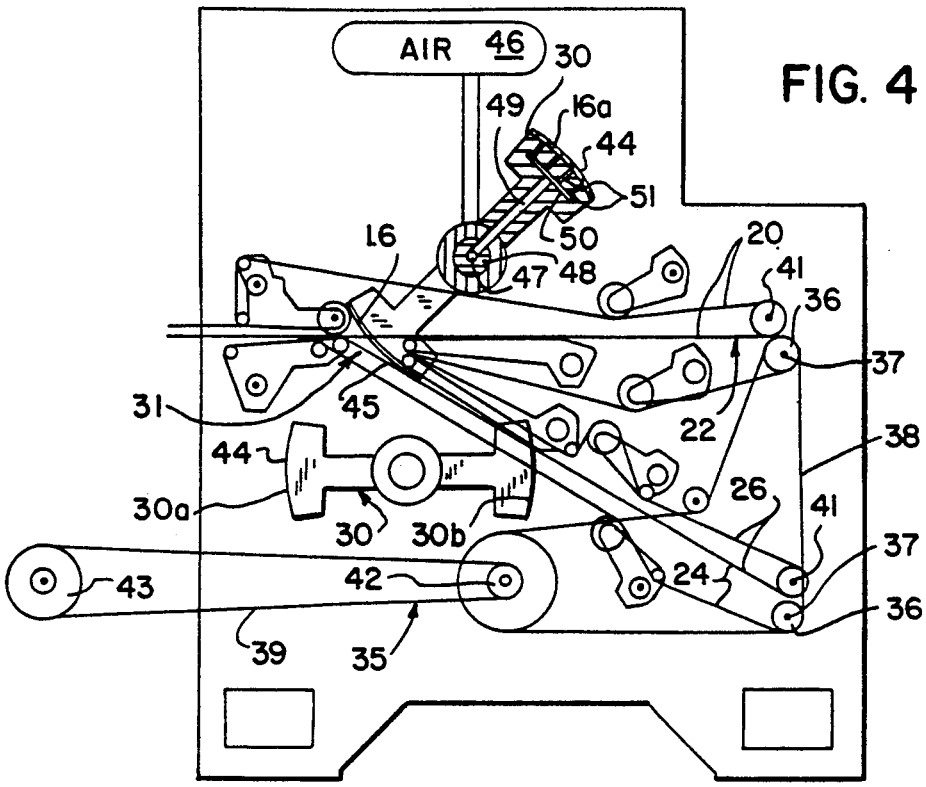
FIG. 4 is a view similar to FIG. 3 illustrating an alternate embodiment in accordance with the teaching of this invention.
Figure 5:
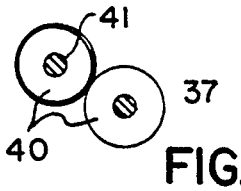
FIG. 5 is a fragmentary view of FIG. 4 illustrating a shaft coupling.

The curved cam surfaces 16*a* and 17*a* of the diverter 15 similarly enter the plane of the conveyor unit 12 tangentially to the supporting belt 14 and essentially at the nip of the opposing belts. Each cam surface 16*a* and 17*a* may be formed as a relatively short circumferential length, such as shown in the embodiment of FIGS. 4 and 5, in contrast to the usual teaching of the prior art. Thus, in a typical system developed for transport of paper signatures having a length greater than the gap length to 22¾ inches, a cam length of six (6) inches was found satisfactory. The cam length is thus sufficiently long to support the leading portion of each signature.

Referring particularly to FIGS. 1 and 3, the conveyor units 11 and 12 are both endless belt conveyors extending from immediately adjacent the discharge end of the coupling conveyor unit 7 and shown including a common input section 19 for transporting of elements 2 from the coupling conveyor 7 into the delivery unit 8, generally as in the above identified copending application.

Conveyor unit 11 includes a horizontal top belt 20 which extends from the coupling unit 7 throughout the length of the delivery unit 8 with a horizontal run 21. A horizontal bottom belt 22 is mounted in downstream relation to the common input section 19 and defines a diverting space or gap 23 within the length of the delivery unit 8. The belts 20 and 22 define the horizontal flow path 5 for transport of the signatures 2 through the common input section 19 and gap 23 through the delivery unit 8. The incoming signature 2 to be transported along this path moves directly across the gap 23 into and between the conveyor belts 20 and 22 forming the horizontal path through the diverter unit 8. In the present invention, the gap 23 is made as short as feasible and required for movement of alternate signatures 2 downwardly into and through gap 23 and into the offset conveyor unit 12, as more clearly shown in FIG. 3.

The inclined conveyor unit 12 includes a bottom endless belt 24. The upstream end of belt 24 is horizontal and in the illustrated embodiment constitutes an input part of the common input section 19. Belt 24 turns downwardly into an inclined belt portion or run 25 which projects at an angle downwardly from the upstream end of the diverting space or gap 23. An inclined conveyor top belt 26 is mounted in parallel operative relationship with the inclined portion of belt 24 in spaced relation to the end of input section 19 and thus provides a gap beneath gap 23 for receiving of a diverted signature 2 and moving the diverted signature into the angulated belt conveyor for grasping and carrying of signature 2 downwardly through the diverter unit 10 to a discharge conveyor unit 9. The pulley 27 for belt 21 is located upstream of the pulley 28 for the belt 26 and establishes a relative short horizontal gap 23. The pulley 28 is located beneath and downstream of pulley 27.

The downwardly diverted signature 2 is positively guided into the nip of the opposed belts 24 and 26 by the diverters 15. Synchronized rotation of the diverters 15 with the cutter unit 6 causes the one signature 2 to move into the horizontal conveyor unit 11, and the next signature to be diverted into conveyor unit 12, with all subsequent pairs of signatures moving respectively in the same alternate paths. The cam segment 16 and 17 support the leading edge portion of each signature for angulated movement and particularly to positively locate the leading portion of sheet 2 into the nip of the belts 24 and 26. The belts 24 and 26 support and transport the signature in positive manner as the trailing end portion of the sheet moves from the gap 23 and through the angulated gap, with any tendency to move within the gaps minimal such that the signature is fully and reliably drawn into the conveyor unit 12.

In the illustrated embodiment of the invention shown in FIGS. 1–3, the horizontal moving signature 2 passes through the gap 23 unsupported. The gap 23 is formed of a minimal length in relationship to the minimum length of a signature 2. The folded signatures 2 with the interconnected folded edge 4 define a somewhat stiffened element which tends to further hold the element in a common plane such that the element moves across the short gap 23 with the leading edge aligned with and moving into gripped engagement by the delivery conveyor belts 20 and 22. Once the leading edge portion of the signature 2 has been grasped by the diverter conveyor belts 20 and 22, the signature 2 is readily supported and in fact transported through the gap 23 as an essentially supported member. The trailing end of signature 2 tends to maintain its horizontal movement. Further, any slight offset of the trailing end portion is readily pulled into the conveyor unit 11 by the conveyor belts for continued transfer through the diverting unit 10, with a reliable transfer of the signature through the horizontal paths.

The next or alternate signature 2 moves into the gap 23 in synchronism with the movement of the diverter 15 and particularly cam segment 16*a* and 17*a* and engages the leading edge portion of the signature as it moves downwardly onto the inclined belt portion 38, and particularly as the signature 2 moves into the nip between the belts 24 and 26 of the inclined conveyor unit 12. In accordance with this invention, the gap and particularly the cam surface is located to pass through the downstream end of the gap and into engagement with the signature 2 and particularly the leading edge portion of the signature to positively deflect the signature downwardly onto the inclined belt and into the belt nip. Again, it is the leading edge portion which is positively moved and transferred into the diverter conveyor. Once the leading portion of the signature is appropriately grasped by the conveyor, the signature is positively transferred through the path and the trailing portion of the signature can be allowed to move freely through the gap structure. Minimal interengagement between the shorter cam surface 16*a* and 17*a* and the signature 2 is desirable to minimize any probability of the surface interaction which in any such apparatus has been considered a source of damage to the surface of the processed element.

In certain applications, the signature may be highly flexible or individual sheets may be fed through the diverter unit. In such applications, individual sheet-like elements may not maintain a characteristic suitable for jumping or moving directly through the gap in the horizontal path. In such applications, the gap can be enlarged and a second diverter unit 30 similar to the illustrated top diverter 15 mounted beneath the gap, such as shown in FIG. 4. The conveyor structures and diverter may correspond to that shown in FIG. 1 and corresponding elements are correspondingly numbered, with the additional diverter and other changes described in detail.

In the embodiment of FIG. 4, a horizontal gap 31 has been slightly enlarged by locating of the bottom conveyor belt 21 of the horizontal conveyor unit 11 in increased spaced relation to the common section 19. The second diverter 30 is constructed similar to that of the top diverter 15 with relatively short cam surfaces 30*a* and 30*b*. The unit is rotated and mounted to move into the gap 31 downstream of the common section and generally slightly upstream of the nip of the horizontal conveyor belts 20 and 22. The signature 2, or other sheet-like element tends to drop downwardly into the gap, the diverter 30 picks up the leading edge portion and moves it upwardly into alignment with the nip of the belts 20 and 22 of the horizontal conveyor 11. The relatively short cam surfaces guides the leading portion of the signature 2 into firm interengagement with the conveyor belts 20 and 22, which then function to fully support and transport the signature 2 even as the cam surface moves from the gap and the trailing portion moves from the common section and through the gap 31 to maintain appropriate controlled transfer of the signature through the diverter for subsequent processing.

The enlarged gap 31 provides sufficient space for movement of the two diverters through the horizontal path and the inclined, path.

The inventors have also discovered that contrary to the normal concept of providing synchronized linear speeds of the diverter surface and the sheet, the linear speeds can be different, and particularly the cam surface may move at a significantly greater relative speed to insure the interengagement of the leading portion of the sheet element for movement into the nip of the conveyor unit. Generally, it has been found that the linear speed of the cam surface can be on the order of 10 percent or more greater than the linear speed of the sheet element, with an operative range including speeds of 8 to 15 percent greater than the linear speed of the element. This differential can be created by either increasing the rotational speed of the diverter or reducing the speed of the conveyor belts and thereby the sheets 2.

Thus, as disclosed in the above embodiment of the invention, the bottom conveyor belts 22 and 26 of the conveyor units 11 and 12 are belt driven from the cutter drive, as shown at 35 in FIG. 4 and generally as more fully disclosed in the previously identified co-pending application. The bottom conveyor belts 22 and 24 are coupled to pulleys 36 on similar shafts 37. A driven belt 38 couples the pulleys to the cutter drive belt 39 as shown in FIG. 4. The opposite ends of shafts 37 are geared coupled as by gears 40 to shafts 41 for the related belts 20 and 26. The opposite ends of shafts 37 are geared coupled thereby establishing corresponding equal linear speed of the diverter conveyor belts. The diverters are coupled to the cutter and are driven in synchronism therewith. Either of the drive couplings can be varied to vary the relative speed of the signatures 2, or other sheet elements, with respect to the diverter cam surfaces 30*a* and 30*b*. A convenient method is to vary the coupling of the diverter's conveyor belt drive to the cutter drive by varying of the coupling pulleys 42 and 43 and thereby reduce the speed of the diverter belts 20–22, 24 and 26 relative to the diverter's cam surfaces 16*a*, 17*a*, 30*a* and 30*b*. In this aspect of the invention, it has been found possible to increase the relative speed differential by a factor of approximately 10 percent. In this aspect of the invention, the total cam surface or the length of the cam surface may be extended to insure the continued support throughout the greater length of the sheet structure, but need not be so constructed.

A differential linear speed between the diverter and the element however does create a relative movement across the surface of the signature. It is therefore desirable to provide an appropriate non-frictional interface between the sheet element and the cam surface during the interengagement.

The cam surfaces may be provided with a very low friction coating 44, such as a plastic sold under the trademark "Duracor" or some similar material to prevent wear and any damaging interengagement with the signature surface.

A low friction interface can also be formed by a very thin air cushion 45 between the cam surface and the path of the signature 2 or other sheet-like element. The air cushion 45 can of course be created in any suitable manner. In the illustrated embodiment of the invention, the diverter 30 is shown connected to an air supply or source 46 to discharge air streams from the cam surfaces 30*a* and 30*b* to create a thin air film layer. The air source 46 is connected through a co-axial passageway 47 in the diverter shaft 48 and an extended passageway 49 through the diverter arm to a circumferential passageway 50 within the cam segment 30. A plurality of air outlets 51 extend from the circumferential passageway 50 outwardly through the cam surface to provide an appropriate low discharge of air to create the air cushion.

Figure 6:
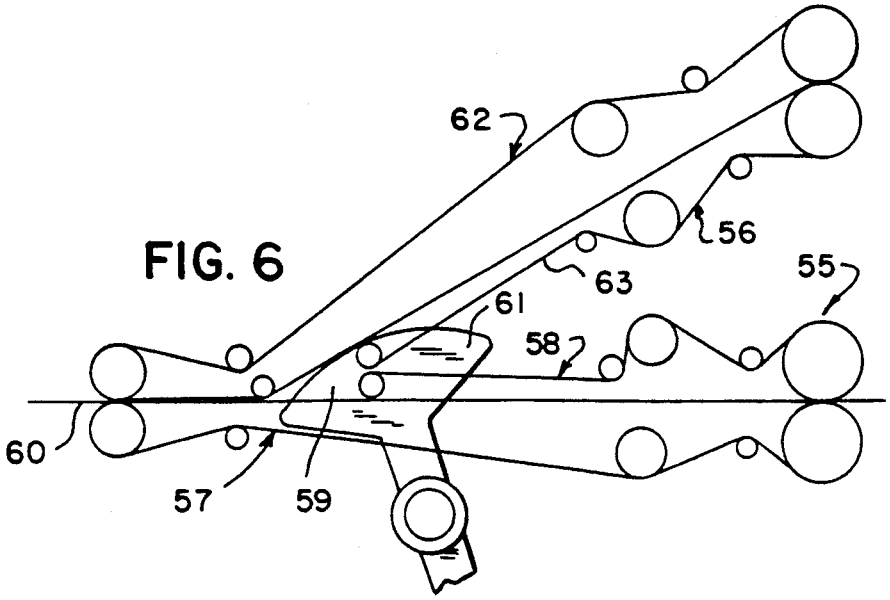
FIG. 6 is a diagrammatic view illustrating a diverter with an upwardly directed alternate path.

The apparatus can also be constructed with a substantial horizontal path and an upwardly inclined alternate path, such as diagrammatically illustrated in FIG. 6. In the embodiment of FIG. 6, a horizontal conveyor unit 55 extends from the infeed end to the discharge end of a diverter apparatus. An upwardly inclined belt conveyor unit 56 extends with the horizontal belt conveyor unit 55 at the infeed end and then diverges upwardly. Conveyor unit 55 includes a horizontal belt conveyor 57 from the infeed end to the discharge end. A top belt conveyor 58 is spaced down stream and defines a diverting gap 59 for diverting of a sheet 60 upwardly into conveyor unit 56. A rotating diverter 61 is rotatably mounted below gap 59 and is constructed and located to positively move the loading portion of the sheet 60 upwardly into conveyor unit 56. The conveyor unit 56 includes a top belt conveyor 62 having an infeed end overlying the bottom belts of conveyor 57 and an inclined portion defining the upward path for sheets 60. A bottom belt conveyor 63 of unit 56 is spaced upwardly within the gap 59 to receive and clamp sheet 60 into the upwardly inclined conveyor. The raised structure avoids the necessity of the horizontally moving sheets spanning a gap structure. The horizontally moving sheets readily move through the gap 59 without the necessity of any top conveyor or other support requirement. If deemed necessary, a fixed or other form of support could of course be provided.

The present invention thus provides a system for controlling of the movement of signatures to a diverting apparatus without the necessity for continuous interengagement and close control of the sheet-like elements passing through the diverter apparatus and in particular provide for the control of the leading portion of each sheet-like element, and further provides a system permitting a significant relative differential in the linear speed of the rotating diverter and the sheet-like element.

Various modes of varying out the invention are contemplated as being within the scope of the following claims particularly pointing out the distinctly claiming the subject matter which is regarded as the invention.

We claim:

1. A separating apparatus for processing a series of sheet-like elements having a bottom surface and an upper surface and moving in a horizontal path, comprising a horizontal conveyor unit having an input end and an output end and operable to transport said sheet-like elements in a substantially horizontal path from said input end and discharge said elements in a substantially horizontal plane at said output end, an angulated conveyor unit having an input end extending downstream in common with said horizontal conveyor unit to define a common input section and extending angularly downwardly from said common input section in an angulated path, said horizontal conveyor unit including a top conveyor extending throughout the length of said horizontal conveyor unit, said horizontal conveyor unit including a bottom conveyor located downstream of said input section and defining a diverting gap and being aligned with the top conveyor to form a nip at the downstream end of said diverting gap, said diverting gap defining a completely unobstructed bottom opening in said horizontal conveyor unit between said input section and said bottom conveyor, said sheet-like element moving with said bottom surface of said element free of support across said unobstructed opening into the nip of said top conveyor and said bottom conveyor whereby said sheet-like element moves across said opening without support beneath said sheet-like element, and a rotating diverter unit mounted above said horizontal conveyor unit and including at least one rotating cam member moving downwardly through said gap and operable to divert a sheet-like element from said horizontal path downwardly through said gap into said angulated conveyor unit.

2. The apparatus of claim 1, wherein said top conveyor of said horizontal conveyor unit includes a plurality of laterally spaced endless tapes moving in a common plane substantially in said upper surface of said sheet-like elements and thereby said horizontal path of said sheet-like elements and providing a holding force on the upper surface of said sheet-like elements moving across said diverting gap.

3. The apparatus of claim 1, wherein said diverter unit includes a curved diverting cam surface of a length substantially less than said sheet-like element, said diverter unit being timed with respect to the movement of said sheet-like elements to engage the leading portion of said sheet-like element to divert the leading edge portion into said angulated conveyor unit, said cam member moving from engagement with said sheet-like element prior to passage of the trailing portion of the sheet-like element whereby said sheet-like element is solely transported thereafter as a result of the angulated conveyor unit.

4. The apparatus of claim 1, wherein said sheet-like elements are multi-page signatures having a common folded edge moving longitudinally through said conveyor units.

5. The apparatus of claim 1, wherein said cam member is rotatably mounted and includes a curved cam surface located to move substantially through the path of said sheet-like element, and means for establishing a thin air film between said cam surface and said sheet-like element to effectively minimize frictional interengagement of said cam surface with said sheet-like element.

6. The apparatus of claim 5, wherein said means to establish said air film includes an air passageway within said diverter unit including a plurality of discharge openings circumferentially spaced along said cam surface, and means for coupling of a pressurized air source to said passageway wherein air is discharged from said cam surface to establish said thin air film between said cam surface and said sheet-like element.

7. The apparatus of claim 1, wherein said cam member is rotatably mounted and includes a curved cam surface having a low friction material covering said cam surface.

8. The apparatus of claim 1, wherein said rotating cam member includes a curved cam surface moving through said gap tangential to said angulated path, said input section positively transporting said sheet-like elements into and through said gap and angulated path at a predetermined essentially constant linear speed, and said cam member rotating at a constant velocity and with said curved surface moving at a linear speed through said angulated path on the order of at least ten percent greater than the linear speed of said sheet-like elements.

9. A diverting apparatus for separating a series of sheet-like elements between a horizontal path and an angulated path, comprising a first belt conveyor operable to transport the sheet-like elements in a first path, a second belt conveyor operable to transport said elements in a second path at a predetermined angular relationship to said first path, at least one diverter element rotatably mounted to move through said first path and thereby divert a sheet-like element into said second path, said diverter element including a curved cam surface engaging the sheet-like element, said sheet-like elements moving into and through said first path at an essentially constant linear speed, and said diverter element rotating at a constant velocity and with said curved surface moving at a linear speed through said first path on the order of at least ten percent greater than the linear speed of said sheet-like elements, and means for establishing a low friction interface between said sheet-like element and said cam surface to effectively minimize frictional interengagement with said sheet-like element.

10. The apparatus of claim 9, wherein said last named means includes a low friction material on said cam surface.

11. The apparatus of claim 9, wherein aid last named means includes an air supply means to establish a thin air film between said cam surface and said sheet-like elements.

12. A diverting apparatus for separating a series of sheet-like elements between a horizontal path and an angulated path, comprising a first belt conveyor operable to transport the sheet-like elements in a first path, a second belt conveyor operable to transport said elements in a second path at a predetermined angular relationship to said first path, at least one diverter element rotatably mounted to move through said first path and thereby divert a sheet-like element into said second path, said diverter element including a curved cam surface engaging the sheet-like element, and means for establishing a low friction interface between said sheet-like element and said cam surface to effectively minimize frictional interengagement with said sheet-like element, wherein at last named means includes an air supply means to establish a thin air film between said cam surface and said sheet-like elements, and wherein said air supply means to establish said air film includes an air passageway within said diverter element terminating in a plurality of discharge openings circumferentially spaced along said cam surface, and means for coupling of a pressurized air source to said passageway wherein air is discharged from said cam surface to establish said thin air film between said cam surface and said sheet-like element.

13. An apparatus for moving horizontally moving sheet-like elements in a planar path through a conveyor unit having a gap in the conveyor unit, comprising input means for feeding said sheet-like elements into said conveyor unit along the planar path of said conveyor unit, a rotating diverter element movable through said gap with a curved cam surface tangential to said path, said input means moving said sheet-like elements into and through said path at a predetermined and essentially constant linear speed, and said diverter element rotating at a constant velocity and with said curved cam surface moving at a linear speed through said gap on the order of at least ten percent greater than the linear speed of said sheet-like elements moving through said gap.

14. The apparatus of claim 13, wherein said conveyor unit includes a horizontal conveyor having an input end and an output end and operable to transport said sheet-like elements in a substantially horizontal plane from said input end and discharge said elements in a substantially horizontal plane at said output end, and an angulated conveyor having an input end extending downstream in common with said horizontal conveyor to define a common input section of said input means and extending angularly downwardly from said common input section, said horizontal conveyor including top endless belt elements extending throughout the length of said horizontal conveyor and a bottom conveyor located downstream of said input section and defining a diverting gap including bottom endless belt elements aligned with the top endless belt elements to form a nip at the downstream end of said diverting gap, said diverting gap defining a completely unobstructed bottom opening in said horizontal conveyor unit, said sheet-like element moving across said gap without support to the underside of the sheet-like element into said nip of said top conveyor and bottom conveyor, said diverter element being mounted above said angulated conveyor and located to move through said gap and diverting a sheet-like element into said angulated conveyor.

15. The apparatus of claim 13, wherein aid curved cam surface has a length substantially less than said sheet-like element, said diverter element being timed with respect to the movement of sheet-like elements to engage the leading portion of said sheet-like element to divert the leading edge portion in said conveyor unit, said cam surface moving from engagement with said sheet-like element prior to passage of the trailing portion of the sheet-like element in said conveyor unit.

16. The apparatus of claim 13, wherein said cam surface includes a low friction exterior surface.

17. The apparatus of claim 13, including air supply means establishing a thin air film between said cam surface and said sheet-like element to effectively minimize frictional interengagement with said sheet-like element.

18. The apparatus of claim 17, wherein said air supply means includes an air passageway within said diverting element terminating in a plurality of discharge openings circumferentially spaced along said cam surface, and means for coupling of a pressurized air source to said passageway wherein air is discharged from said cam surface to establish said thin air film between said cam surface and said sheet-like element.

19. A diverter apparatus for forming and separating a series of signatures including a plurality of integral pages folded on a common edge, comprising a cutter apparatus adapted to receive a web of indefinite lengths including repeated successive signatures thereon and operable to separate said web into a series of separate signatures moving in spaced succession in a planar horizontal path with the folded edge moving longitudinally in the direction of said path, a diverter unit including a horizontal conveyor unit and an angulated conveyor unit, said conveyor units having a common horizontal input section, said horizontal conveyor unit having a bottom conveyor extending from and through said common input section to a discharge end and having a top conveyor spaced downstream of said inlet section to define a diverting top gap above said horizontal conveyor unit, said angulated conveyor unit having a top conveyor including said inlet section and defining a path extending upwardly from said inlet section and a bottom conveyor having an input end spaced upwardly from said inlet section and the lower portion of said top conveyor, first and second rotating diverter elements each having at least one curved cam surface and the circumferential length of said curved cam surfaces having a length substantially less than the length of said signature, said first diverter element being located beneath said horizontal conveyor unit, said curved cam surface having a constant radius with respect to the axis of rotation of said first diverter element, said axis being located to move said curved cam surface tangentially through the nip between said top conveyor and said bottom conveyor of said horizontal conveyor unit, said second diverter element rotating with its cam surface moving tangentially through the nip of the bottom conveyor and top conveyor of said angulated conveyor unit, means coupled to said diverter elements for rotating said cam surfaces in timed relation to the movement of the signatures into the separating apparatus to engage a leading portion of each assigned signature and direct the leading edge portion into the nip of the corresponding horizontal conveyor unit and the nip of the angulated conveyor unit and with said cam surface disengaging said signature prior to movement of the trailing portion into said nip, and said conveyors constituting the sole source for transporting of the element through said diverter unit after the diverter element disengages said signature, said cam surface includes a low friction exterior surface, including an air supply supply means for establishing a thin air film between said cam surfaces and said sheet-like elements to effectively minimize frictional interengagement with said sheet-like element, and wherein said air supply means includes an air passageway within each said diverting elements and a plurality of discharge openings circumferentially spaced along said cam surface, and means for coupling of a pressurized air source to said passageway wherein air is discharged from said cam surface to establish said thin air film between said cam surface and said sheet-like element.

* * * * *

UNITED STATES PATENT AND TRADEMARK OFFICE

CERTIFICATE OF CORRECTION

PATENT NO. : 5,293,797

DATED : March 15, 1994

INVENTOR(S) : MICHAEL H. SPALDING ET AL

It is certified that error appears in the above-identified patent and that said Letters Patent is hereby corrected as shown below:

Claim 11, col. 9, line 65, delete "aid" and substitute therefor ---said---; Claim 15, col. 11, line 5, delete "aid" and substitute therefor ---said---.

Signed and Sealed this

Sixth Day of December, 1994

*Attest:*

*Attesting Officer*

BRUCE LEHMAN

*Commissioner of Patents and Trademarks*